United States Patent [19]

Dolhyj et al.

[11] 4,412,847

[45] Nov. 1, 1983

[54] MOTOR FUEL ADDITIVE

[75] Inventors: Serge R. Dolhyj, Parma; Louis J. Velenyi, Lyndhurst; Andrew T. Guttmann, Maple Heights, all of Ohio

[73] Assignee: The Standard Oil Company, Cleveland, Ohio

[21] Appl. No.: 948,351

[22] Filed: Oct. 3, 1978

[51] Int. Cl.[3] ..... C10L 1/18

[52] U.S. Cl. ..... 44/77

[58] Field of Search ..... 44/77; 568/658, 626, 568/630

[56] References Cited

U.S. PATENT DOCUMENTS

| | | | |
|---|---|---|---|
| 2,046,243 | 6/1936 | Buc . | |
| 2,248,518 | 7/1941 | Stanley et al. | 568/626 |
| 2,411,428 | 11/1946 | Hechenbleikner | 568/626 |
| 2,445,500 | 7/1948 | Tyrer | 568/630 |
| 2,487,832 | 11/1949 | Searle | 568/630 |
| 2,529,887 | 11/1950 | Smutz | 568/630 |
| 2,777,000 | 1/1957 | Shaw | 568/626 |
| 3,476,814 | 11/1969 | Meltsner | 44/77 |
| 3,594,136 | 7/1971 | Rosen | 44/77 |
| 3,836,342 | 9/1974 | Shang et al. | 252/386 |

OTHER PUBLICATIONS

"National Advisory Committee for Aeronautics Wartime Report," Jones et al., Mar. 1946.

"Summary of NACA Research on Antiknock Characteristics of Hydrocarbons and Ether," Henry Barnett, Proc. 3rd, World Petro Congr., Hague 1951, Sec. VI, pp. 397–419.

"The Effect of Tetraethyl Lead on Flame Propagation and Cyclic Dispersion in Spark-Ignition Engines", Ellison et al., Journ. of the Institute of Petro., vol. 54, No. 537, Sep. 1968.

"Are There Substitutes for Lead Antiknocks", Unzelman et al., Proc., Dev. Refg., Amer. Petrol. Inst., 1971.

*Primary Examiner*—Charles F. Warren

*Assistant Examiner*—Y. Harris-Smith

*Attorney, Agent, or Firm*—William A. Heidrich; Herbert D. Knudsen; Larry W. Evans

[57] ABSTRACT

Aryl ethers, e.g., cumylmethylether and anisole, are particularly effective additives for improving the octane number of motor fuels. These aryl ethers are especially useful in increasing the octane number of unleaded gasolines.

15 Claims, No Drawings

MOTOR FUEL ADDITIVE

BACKGROUND OF THE INVENTION

The present invention relates to motor fuel additives.

To perform satisfactorily in modern, high performance automotive engines, today's gasolines must meet exacting specifications. Characterstics such as knock-resistance (indicated by octane number) and vaporizing curve must be tailored to meet the needs of the particular engines in which the gasoline will be used.

To prevent annoying, fuel wasting, potentially damaging engine knock at all engine speeds and loads, a good gasoline must have high anti-knock quality throughout its entire distillation range. In 1919 it was found that knock could be suppressed by the addition of tetraethyl lead and other alkyl lead compounds. However, leaded gasoline is being phased out due to the environmental problems associated with it. This lead to the development of another anti-knock additive, methylcyclopentadienyl manganese tricarbonyl (MMT). Unfortunately, the Environmental Protection Agency has also recently banned the use of MMT in gasoline.

Many other compounds have been considered as anti-knock gasoline additives. Specifically, alcohols such as methanol and ethers such as MTBE (methyl-tertiary-butyl ether) have been found to increase the octane number of gasoline. However, each of these compounds is disadvantageous for various different reasons.

Furthermore, it is important for fast warm-ups, smooth acceleration, and proper distribution of the fuel among the entire cylinders, that the gasoline vaporize at an increased rate as carburetor and manifold temperatures rise. Thus, gasolines need a mixture of low boiling components for easy starting and high boiling components for smooth acceleration and high mileage per gallon. This high mileage per gallon is a critical factor in the present-day gasoline market. Unfortunately, many of the prior art anti-knock additives are low boiling compounds.

It has now been discovered that aryl ethers are particularly effective anti-knock additives for gasolines. Specifically, the instant aryl ethers substantially increase the octane number of gasoline. Furthermore, their high boiling points will result in smoother acceleration and higher mileage per gallon of gasoline than prior art additives. Thus, the instant aryl ethers are likely to become an important part of future gasoline blends.

SUMMARY OF THE INVENTION

It has now been discovered that aryl ethers can be used as gasoline additives to increase the octane number. It has also been discovered that cumylmethyl ether (CME) and anisole are particularly effective in increasing the octane number of unleaded gasolines.

Thus, the present invention provides a novel motor fuel comprising a mixture of hydrocarbons boiling within the gasoline range having its octane number improved by an addition of an aryl ether boiling within the gasoline boiling range, and having the structure:

$$R_1—(R_2)_n—O—R_3$$

wherein $R_1$ is selected from the group consisting of phenyl, substituted phenyl substituted with one methyl group, substituted phenyl substituted with two methyl groups and substituted phenyl substituted with one ethyl group;

$R_2$ is selected from the group consisting of substituted methane substituted with one or two methyl groups, ethane, and substituted ethane substituted with one or two methyl groups;

$R_3$ is selected from the group consisting of methyl and ethyl; and wherein n is 0 or 1.

In a specific embodiment, the instant invention relates to a motor fuel comprising a mixture of hydrocarbons boiling within the gasoline range having its octane number improved by the addition of at least one of cumylmethyl ether or anisole.

DETAILED DESCRIPTION

The instant invention relates to a motor fuel comprising gasoline and at least one aryl ether additive. The aryl ether additive has the following structure:

$$R_1—(R_2)_n—O—R_3$$

wherein $R_1$ is selected from the group consisting of phenyl, substituted phenyl substituted with one to two methyl groups, and substituted phenyl substituted with one ethyl group; and $R_2$ is selected from the group consisting of substituted methane substituted with one or two methyl groups, ethane, and substituted ethane substituted with one or two methyl groups;

$R_3$ is selected from the group consisting of methyl and ethyl; and wherein n is 0 or 1.

Preferably, $R_1$ is selected from the group consisting of phenyl and substituted phenyl substituted with one methyl group; $R_2$ is selected from the group consisting of substituted methane substituted with one or two methyl groups; $R_3$ is methyl; and n is 0 or 1. Most preferably, the aryl ether is at least one of cumylmethyl ether or anisole.

To obtain the inventive motor fuel composition, the aryl ether and the gasoline are simply mixed together. Although the aryl ether additives may be blended with gasoline in any desired proportion, it is preferred that the motor fuel contain from 3—30% of the aryl ether. More preferably, the motor fuel contains from 5–20% aryl ether and most preferably, the motor fuel contains about 10% aryl ether.

The aryl ethers encompassed by the instant invention are easily prepared by prior art methods. In this regard, U.S. Pat. No. 2,248,518 discloses a process for making aryl ethers by combining aryl substituted mono-olefins such as styrene with an alcohol in the presence or an acid catalyst. Shaw, in U.S. Pat. No. 2,777,000, also discloses a process for preparing aryl ethers. Shaw's process comprises reacting alpha-methyl styrene in an alcohol in the presence of hydrogen chloride.

The inventive aryl ether must have a boiling point within the boiling range of gasoline. Preferably, the aryl ether will boil at about 200° C.

The instant aryl ethers may be combined with other octane improvers in a gasoline blend. In particular, a gasoline additive comprising an aryl ether and MTBE is within the contemplation of the instant invention.

SPECIFIC EMBODIMENT

In order to more thoroughly describe the present invention, the following examples are presented. In each of these examples an octane improver was blended at a 10% level in an unleaded gasoline.

The anti-knock quality of gasolines is rated by two laboratory knock-test procedures, both of which employ the cooperative fuel research (CFR) knock-test engine. The CFR engine is a single cylinder 4-stroke engine in which the compression ratio can be varied at will. This engine has been adopted as a standard for determining octane number. To determine a fuel's anti-knock quality, the CFR engine is operated on the fuel under a standard set of conditions and the compression ratio is adjusted to given a standard level of knock intensity. This knock level is then bracketed by two blends of the reference fuels, one of which knocks a little more than the test fuel, the other of which knocks a little less. The knock rating of the fuel being rated is determined by interpolation between the knock meter readings of the reference fuels to find reference fuel composition that just matches the knock meter reading of the test sample.

The two laboratory knock test procedures are the motor method (ASTMD-2623) and the research method (ASTMD-2699). The research method was adopted as a testing procedure when it became apparent that newer refinery processes in engine improvements gave gasolines much better road performances than their motor method ratings would indicate. Both methods continue in use, however, because together they predict a gasoline's road performance better than either does alone. If two fuels have the same motor method octane number, the one with the greater research method rating will usually satisfy a greater percentage of the cars on the road. The difference between a gasoline's research rating and its motor rating is called insensitivity. This difference indicates how sensitive the gasoline is, in terms of anti-knock performance, to more severe engine operating conditions. Among fuels of equal research octane number, the fuel having the least sensitivity generally will give the best road anti-knock performance.

The following experiments were conducted:

EXAMPLE 1

A 10% by volume blend of cumyl methyl ether and unleaded gasoline was prepared. The octane number of this blend was determined by both the research method and the motor method. The results are shown in Table I.

EXAMPLE 2

A blend of 5% by volume CME, 5% MTBE, and 90% unleaded gasoline was prepared. The octane number of this blend was determined by the procedures outline in Example 1. The results are shown in Table I.

EXAMPLE 3

A 10% by volume blend of anisole and unleaded gasoline was prepared. The octane number of this blend was determined by the procedures outline in Example 1. The results are shown in Table I.

Comparative Example A

A 10% blend by volume of methyl tertiary butyl ether and gasoline was prepared. The octane number of the blend was determined by the procedures outlined in Example 1. The results are shown in Table I.

Comparative Example B

The octane number of the unleaded gasoline used in Examples 1, 2 and 3 and in Comparative Example A was determined by the procedures outlined in Example I. The results are shown in Table I.

TABLE I

OCTANE NUMBER OF BLENDS
Gasoline: Unleaded Type

| Example | Fuel Type | Octane Number Motor Method | Octane Number Research Method |
|---|---|---|---|
| 1 | 10% CME + 9% Gasoline | 94.2 | 85.8 |
| 2 | 5% CME + 5% MTBE + 90% Gasoline | 94.2 | 85.4 |
| 3 | 10% Anisole + 90% Gasoline | 94.4 | 85.3 |
| A | 10% MTBE + 90% Gasoline | 94.2 | 85.0 |
| B | 100% Gasoline (Reference) | 91.8 | 83.8 |

It is clear from Table I that the addition of an aryl ether substantially increases the octane number of gasoline. This is particularly true when the octane number is rated by the research method. In fact, the aryl ether anti-knock additive increased the research method octane number by a greater amount than MTBE, a known anti-knock additive. Thus, in view of the above discussion, it is clear that gasoline containing CME or anisole will satisfy the engine requirements of more cars on the road than gasoline containing MTBE.

Although only a few embodiments of the present invention have been specifically described above, it should be appreciated that many additions and modifications can be made without departing from the spirit and scope of the invention. These and all other modifications are intended to be included within the scope of the present invention, which is to be limited only by the following claims.

We claim:

1. A motor fuel comprising a blend of (1) a mixture of hydrocarbons boiling within the gasoline range, and (2) an aryl ether, said aryl ether having the structure:

$$R_1—(R_2)—O—R_3$$

wherein $R_1$ is selected from the group consisting of phenyl, substituted phenyl substituted with one methyl group, substituted phenyl substituted with two methyl groups and substituted phenyl substituted with one ethyl group;

$R_2$ is selected from the group consisting of substituted methane substituted with one or two methyl groups, ethane, and substituted ethane substituted with one or two methyl groups;

$R_3$ is selected from the group consisting of methyl and ethyl.

2. The motor fuel of claim 1 wherein $R_1$ is selected from the group consisting of phenyl and substituted phenyl substituted with one methyl group.

3. The motor fuel of claim 1 wherein $R_2$ is selected from the group consisting of substituted methanes substituted with one or two methyl groups.

4. The motor fuel of claim 1 wherein $R_3$ is methyl.

5. The motor fuel of claim 1 wherein the aryl ether is cumylmethyl ether.

6. The motor fuel of claim 1 wherein the motor fuel contains from 3 to 30% by volume of the aryl ether.

7. The motor fuel of claim 6 wherein the motor fuel contains from 5 to 20% aryl ether.

8. The motor fuel of claim 7 wherein the motor fuel contains about 10% aryl ether.

9. The motor fuel of claim 1 wherein the aryl ether boils between 70° and 220° C.

10. The motor fuel of claim 1 wherein the aryl ether boils between 180° and 210° C.

11. The motor fuel of claim 9 wherein the aryl ether boils at about 200° C.

12. The motor fuel of claim 1 wherein said motor fuel comprises an unleaded gasoline.

13. The motor fuel of claim 1 wherein said motor fuel does not contain any methyl-substituted phenolic additives.

14. The motor fuel of claim 1 wherein said motor fuel does not contain any group IIA metal carbonate additives.

15. The motor fuel of claim 1 wherein the amount of the aryl ether is sufficient to improve the octane number of the mixture of hydrocarbon boiling within the gasoline range.

* * * * *